US007395746B2

(12) United States Patent
Bond et al.

(10) Patent No.: US 7,395,746 B2
(45) Date of Patent: Jul. 8, 2008

(54) SHELL RETENTION DEVICE FOR AMMUNITION LOADING MACHINE

(75) Inventors: Ronald D Bond, Grand Island, NE (US); Kenneth L Elshof, Grand Island, NE (US); Greg L Palkowitsh, Alda, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 463 days.

(21) Appl. No.: 11/191,800

(22) Filed: Jul. 27, 2005

(65) Prior Publication Data

US 2007/0022870 A1 Feb. 1, 2007

(51) Int. Cl.
*F42B 33/00* (2006.01)

(52) U.S. Cl. ..... 86/24; 86/44; 86/28

(58) Field of Classification Search ..... 86/44, 86/24, 23, 25, 28, 31, 33
See application file for complete search history.

(56) References Cited

U.S. PATENT DOCUMENTS 3,157,407 A * 11/1964 Aulabaugh ..... 279/36
3,319,511 A * 5/1967 McLean ..... 86/44
3,896,699 A * 7/1975 Cerro ..... 86/44
3,916,758 A * 11/1975 Ashbrook ..... 86/44
4,142,441 A * 3/1979 Schaenzer ..... 86/24
4,178,189 A * 12/1979 Mancini et al. ..... 134/6
4,222,305 A * 9/1980 Lee ..... 86/37
4,331,063 A * 5/1982 Schaenzer ..... 86/36
4,425,833 A * 1/1984 Purdie ..... 86/44
5,202,529 A * 4/1993 Shields ..... 86/23
6,397,718 B2 * 6/2002 Jamison et al. ..... 86/19.7
6,772,668 B2 * 8/2004 Shields ..... 86/31

* cited by examiner

*Primary Examiner*—James S Bergin
(74) *Attorney, Agent, or Firm*—Bennet K. Langlotz; Langlotz Patent Works

(57) ABSTRACT

An ammunition manufacturing machine has a frame with a die receptacle, and a reciprocating ram having a free end movable toward and away from the die receptacle. The free end of the die receives a removable shell holder having a recess shaped to receive the base of a casing. The recess has a flat floor portion, and the shell holder is removable along a path lateral to the axis of the ram's motion. A retention element removably encompasses at least part of the shell holder and of the free end of the ram, so that the shell holder is secured by the retention element against lateral removal. The retention element may have a flat upper surface aligned with the floor of the shell holder recess, to provide a guide for sliding the case into the shell holder. The retention element may also have an internal O-ring that compressibly surrounds the end of the ram, to provide a friction fit that holds the retaining element on the ram.

20 Claims, 3 Drawing Sheets

SHELL RETENTION DEVICE FOR AMMUNITION LOADING MACHINE

FIELD OF THE INVENTION

This invention relates to the manufacture of firearms ammunition, and more particularly to machine elements for retaining casings during loading.

BACKGROUND AND SUMMARY OF THE INVENTION

Shooting hobbyists seeking economy and/or high precision ammunition employ hand loading machines to manufacture their own cartridges from casings, powder, and bullets. A basic loading machine is a press with a frame, and a reciprocating ram that moves toward and away from a die. The base of a metal casing is held by a case- or shell-holder device on the end of the ram, and the case is forced into a die for each of the manufacturing steps such as sizing the case and seating the bullet.

The shell holder has a recess to receive the base of the casing, with the sidewalls of the recess having an undercut groove that closely receives the rim at the base of the cartridge. This secures the case to the ram when it is withdrawn from the die. The recess does not fully encircle the casing, but is open on one side so that cases may be laterally inserted and removed from the recess. The flat floor of the recess extends in a plane to the periphery of the shell holder at the side opening.

The shell holder is secured to the ram by similar means, with a flange or rim on the base of the shell holder engaging a pocket on the face of the ram, with the pocket having an undercut receiving the rim, and a lateral opening to allow lateral insertion and removal of shell holders, which are of different sizes for different cartridge specifications. Thus, the shell holder is robustly secured to the ram against axial forces. However, it is desirable to secure the shell holder to the ram against unintended lateral removal during use. The insertion and removal of cases into the shell holder could dislodge it from the ram, or cause it to be slightly misaligned, resulting in spoiled production.

Accordingly, existing shell holders are retained by a wire spring connected to the ram. The spring generates a moderate force that is adequate to resist inadvertent removal of the shell holder, but limited enough to allow the holder to be removed with deliberate force. While effective, spring retention devices have certain disadvantages. The production of small wire springs is imprecise, with dimensional and strength variations being difficult to eliminate. Cutting of spring wire can generate burrs, which can affect operation if not of a consistent size and orientation on the part. Pre-assembly inspection of springs is required, adding to production time and cost to fabricate a loading machine.

In addition, conventional loading machines require dexterity of the user, including the step of positioning the case in the shell holder. This must be done for each of the several manufacturing steps. The groove into which the case rim must be inserted is small, and requires careful alignment, and may be difficult for the user to see with hands and the machine frame obscuring the user's view of the insertion process. The case must be aligned axially and laterally with the groove, with few useful alignment points of reference to guide insertion.

The present invention overcomes the limitations of the prior art by providing an ammunition manufacturing machine. The machine has a frame with a die receptacle, and a reciprocating ram having a free end movable toward and away from the die receptacle. The free end of the ram receives a removable shell holder having a recess shaped to receive the base of a casing. The recess has a flat floor portion, and the shell holder is removable along a path lateral to the axis of the ram's motion. A retention ring removably encompasses at least part of the shell holder and of the free end of the ram, so that the shell holder is secured by the retention element against lateral removal. The retention element may have a flat upper surface aligned with the floor of the shell holder recess, to provide a guide for sliding the case into the shell holder. The retention element may also have an internal O-ring that compressibly surrounds the end of the ram, to provide a friction fit and allow for variations of size of the ram, holds and centers the retaining element on the ram.

DETAILED DESCRIPTION OF A PREFERRED EMBODIMENT

Figure 1:
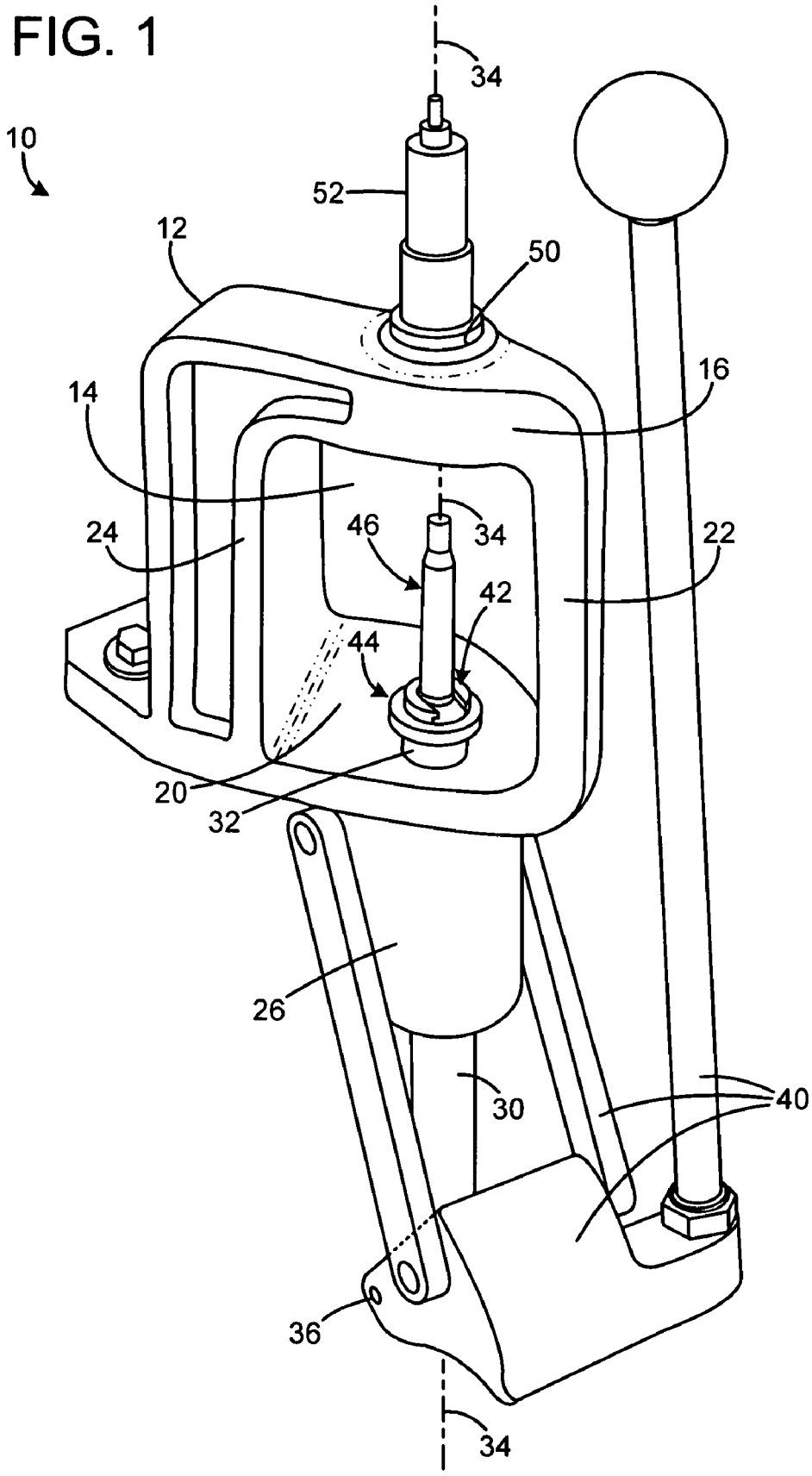
FIG. 1 is a perspective view of an ammunition loading machine according to a preferred embodiment of the invention.

FIG. 1 shows a loading machine or press 10 having a rigid frame 12 that has a main opening 14 defined by an upper span 16, a lower span 20, a front span 22, and a rear span 24. A sleeve portion 26 of the frame extends vertically downward from the lower span, and defines a bore.

A ram 30 is closely received by the bore. The ram has an free upper end 32 that protrudes into the frame opening 14, and which defines a main axis 34. The lower end of the ram is connected by a pivot pin or bolt 36 to an arm linkage 40, so that moving the linkage vertically reciprocates the ram. A cartridge or shell holder 42 is attached to the free end of the ram, and is secured in place by a retainer ring 44, as will be discussed in detail below. The rimmed base of a metallic cartridge case 46 is received in the shell holder, so that it may be processed by forcible insertion into the die, such as to size the case.

The upper span of the frame defines a die receptacle 50 centered on the main axis 34. The receptacle receives a standard loading die 52, which may be interchanged with other dies for different functions and calibers.

Figure 2:
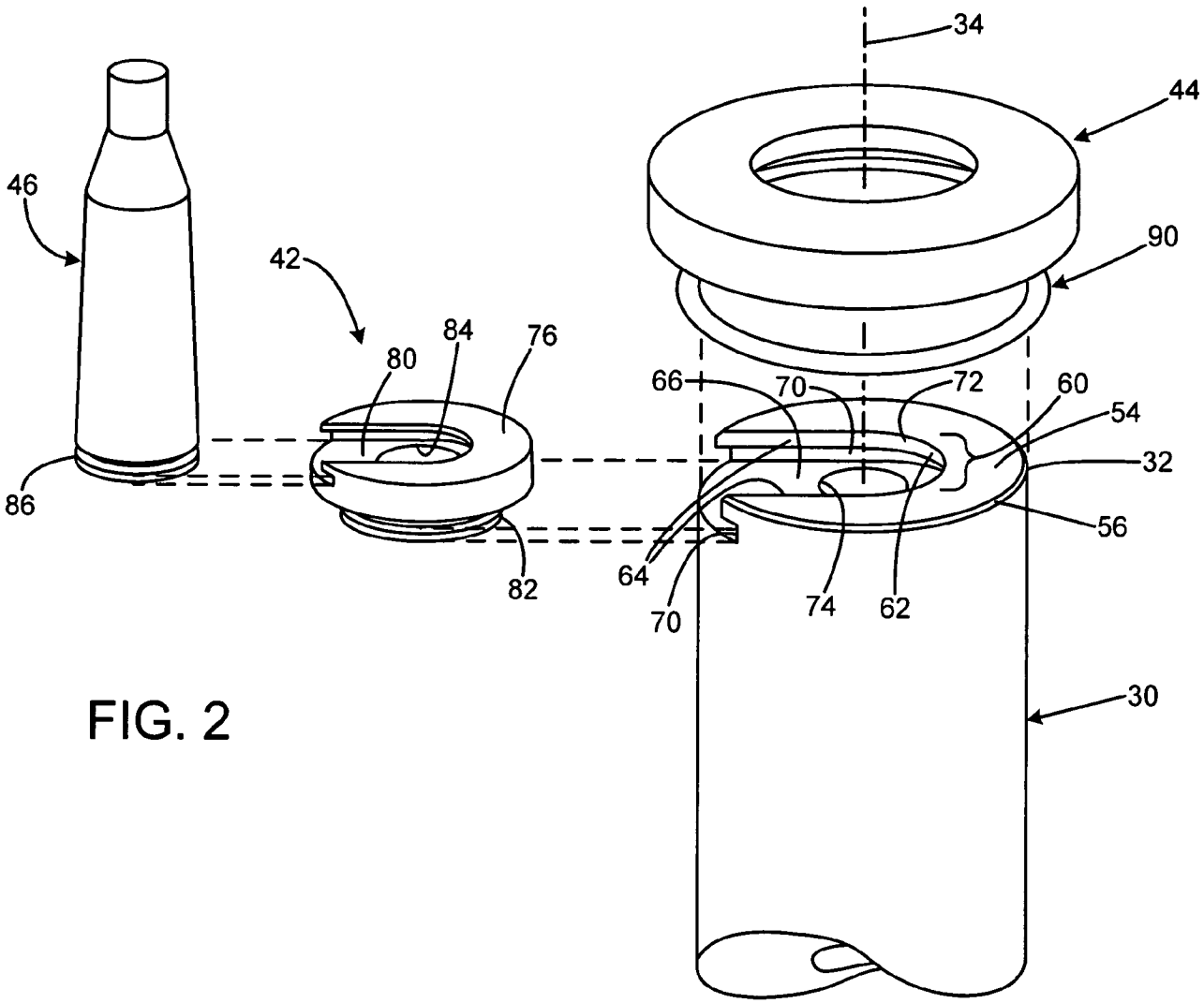
FIG. 2 is an exploded view of the shell retention elements of the machine of FIG. 1.

FIG. 2 shows the free end of the ram, and how the shell holder 42 and retainer ring are shaped for interconnection. The ram is a straight cylinder with a circular cross section. Rams used in machines from different manufacturers may differ slightly or substantially. But all for which the illustrated shell holder and retainer are intended have a nominal outside diameter of 0.875 inch, or 1.00 inch. The ram has a circular upper face 54 having a periphery with a chamfer 56. A recess 60 is defined in the upper face, and has a U-shaped periphery with a semicircular end portion 62 that is essentially concentric with the axis 34, and parallel sides 64 extending to the edge of the ram. The recess has a flat floor surface 66 oriented perpendicular to the axis 34. The periphery of the recess 60 has a groove 70 at the floor, with an overhanging rim 72 at the ram face 54 defining the groove. The ram further defines an axial bore 74.

The shell holder 42 is generally a flat circular disc with an upper surface 76 defining a recess 80 with a U-shaped periphery, with an undercut groove at the periphery in essentially the same form as on the ram face. The holder 42 has a lower surface with a protruding flanged button 82. The flanged button is sized and shaped to closely fit in the ram recess 60, by sliding laterally into the recess with the button flange engaging the ram recess' peripheral groove. The holder defines a central aperture 84 for receiving spent primers during the de-priming process of manufacturing. The holder recess 80 is sized and shaped to fit the rimmed base 86 of the cartridge case 46, as the ram recess receives the holder.

Figure 3:
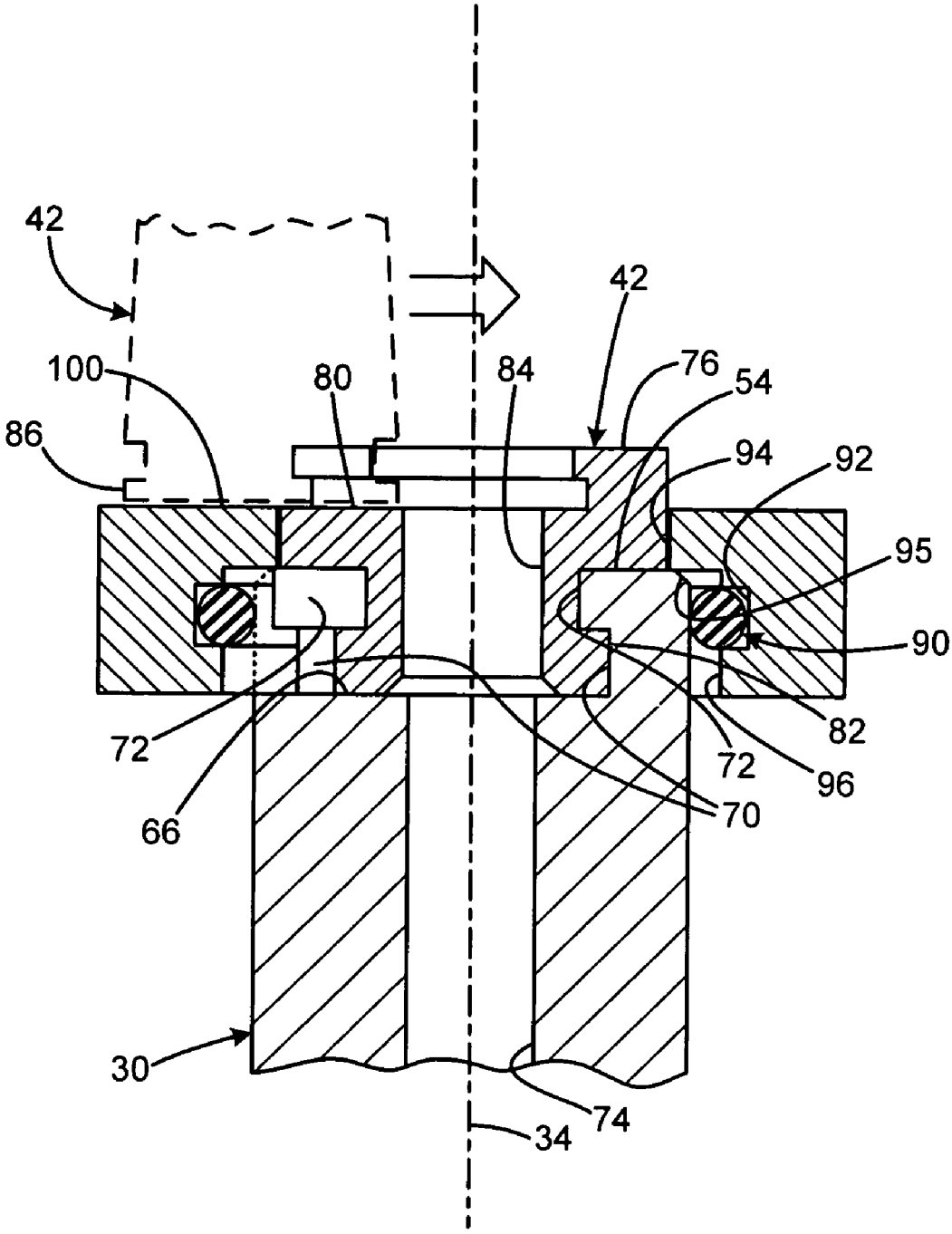
FIG. 3 is an enlarged sectional side view of the retention element of the embodiment of FIG. 1.

An elastomeric O-ring 90 has an inside diameter to closely receive the ram with a slight interference fit, and an outside diameter to fit within the interior of the retainer ring, bearing against an inward facing sidewall 92, as shown in FIG. 3. In the assembled condition shown in FIG. 3, the button flange 82 of the holder is fully seated in the semicircular portion of the ram recess groove 70. As shown, the ram recess and the holder recess 80 are oriented toward the left, but they need not be aligned in actual use, as the holder may be in any rotational orientation. In the installed condition, the holder is concentric with the ram, and the apertures 74, 84 are aligned.

FIG. 3 shows the alignment ring having an upper aperture portion 94 that closely encompasses the shell holder, with the interior sidewall 92 having a larger diameter than the upper aperture portion to receive the O-ring. The upper aperture diameter is less than that of the ram face (as reduced by chamfer) so that the a lower face 95 of the upper portion 94 rests on the ram face to define the axial position of the installed ring. A lower rim 96 of the ring has a diameter slightly smaller than that of the wall 92, to prevent the O-ring from escaping. The rim 96 diameter is larger than the outside diameter of the ram to provide adequate clearance.

The retainer ring has a flat upper face 100 that is coplanar and flush with the holder's recess floor surface 80. This allows the ring face portion adjacent to the holder recess' lateral opening to serve as a "porch" to guide the insertion of a case 42 into the holder. The user has a broad surface on which to set case head, before sliding it laterally into the recess 80. Instead of having to align the axial and lateral location of the case to insert into the recess, the user need only rest the case on the ring, then let the respective sides of the recess guide the case into position.

In the preferred embodiment, the O-ring is an elastomer such as silicone, and the remaining parts are formed of steel. The retainer ring has a diameter at the upper aperture 94 of 0.816, which is adequately small compared to the 0.875 or 1.00 inch diameter ram to provide axial seating of the ring on the ram. The diameter 92 that receives the O-ring is 1.130 inch, and the lower diameter 96 is 1.003 inch. The thickness between surface 95 and face 100 is 0.130 inch, which provides the flush porch surface for a standard shell holder. The O-ring has an inside diameter of 0.875, an outside diameter of 1.125, and thus a nominal thickness of 0.125. The O-ring is used in conjunction with an 0.875 inch diameter ram, while the close fit of the ring is relied on for use with a 1.000 inch diameter ram.

While the above is discussed in terms of preferred and alternative embodiments, the invention is not intended to be so limited. For instance, the retainer ring may be held on the ram by means other than an O-ring, such as metal springs, mechanical fasteners, magnetic elements, gravity, closeness of fit, or friction.

The invention claimed is:

1. An ammunition manufacturing machine comprising:

a frame including a die receptacle;

a ram defining a ram axis reciprocating along the ram axis with respect to the frame, and having a free end movable toward and away from the die receptacle;

a removable shell holder having a recess shaped to receive the base of a casing and connected to the free end of the ram;

the recess having a flat floor portion;

the shell holder being removable along a path substantially perpendicular to the axis;

a retention element removably encompassing at least a portion of the shell holder and at least a portion of the free end of the ram, such that lateral removal of the shell holder is prevented by the retention element.

2. The ammunition manufacturing machine of claim 1 wherein the retention element is a ring having a flat major surface facing the die receptacle, and wherein the major surface is coplanar with the floor of the shell holder.

3. The ammunition manufacturing machine of claim 1 wherein a portion of the major surface of the retention element is adjacent to the floor of the shell holder, such that a casing base may slide across the major surface onto the floor.

4. The ammunition manufacturing machine of claim 1 wherein the retention element includes attachment means for securing to the ram.

5. The ammunition manufacturing machine of claim 4 wherein the attachment means is a compressible O-ring encompassing a portion of the ram.

6. The ammunition manufacturing machine of claim 5 wherein the O-ring defines an interior diameter smaller than a selected diameter associated with the ram, such that an interference fit is provided between the O-ring and ram.

7. The ammunition manufacturing machine of claim 5 wherein the O-ring is elastomeric.

8. A retention element for an ammunition manufacturing machine having a ram defining and reciprocating along a ram axis, and having a free end connected to a removable shell holder removable in a direction substantially perpendicular to the ram axis and having a recess shaped to receive the base of a casing and having a flat floor portion, the retention element comprising:

a body defining a first aperture portion sized to removably encompassing at least a portion of the shell holder;

the body defining a second aperture portion sized to removably encompass at least a portion of the free end of the ram, such that removal of the shell holder is prevented by the retention element; and the body having a flat major surface coplanar with the floor of the shell holder.

9. The retention element of claim 8 wherein a portion of the major surface of the retention element is adjacent to the floor of the shell holder, such that a casing base may slide across the major surface onto the floor.

10. The retention element of claim 8 wherein the retention element is a ring.

11. The retention element of claim 8 wherein the retention element includes attachment means for securing to the ram.

12. The retention element of claim 11 wherein the attachment means is a compressible O-ring encompassing a portion of the ram.

13. The retention element of claim 12 wherein the O-ring defines an interior diameter smaller than a selected diameter associated with the rain, such that an interference fit is provided between the O-ring and ram.

14. The retention element of claim 12 wherein the O-ring is elastomeric.

15. A retention element for an ammunition manufacturing machine having a ram defining and reciprocating along a ram axis, and having a free end connected to a removable shell holder removable in a direction substantially perpendicular to the ram axis and having a recess shaped to receive the base of a casing and having a flat floor portion, the retention element comprising:

a body defining a first aperture portion sized to removably encompassing at least a portion of the shell holder;

the body defining a second aperture portion sized to removably encompass at least a portion of the free end of the ram, such that removal of the shell holder is prevented by the retention element; and attachment means for securing the retention element to the ram.

16. The retention element of claim 15 wherein the attachment means is a compressible O-ring encompassing a portion of the ram.

17. The retention element of claim 16 wherein the O-ring defines an interior diameter smaller than a selected diameter associated with the ram, such that an interference fit is provided between the O-ring and ram.

18. The retention element of claim 16 wherein the O-ring is elastomeric.

19. The retention element of claim 15 wherein the retention element is a ring having a flat major surface facing the die receptacle, and wherein the major surface is coplanar with the floor of the shell holder.

20. The retention element of claim 15 wherein a portion of the major surface of the retention element is adjacent to the floor of the shell holder, such that a casing base may slide across the major surface onto the floor.

* * * * *